US006926780B2

(12) United States Patent
Xiong et al.

(10) Patent No.: US 6,926,780 B2
(45) Date of Patent: Aug. 9, 2005

(54) METHOD OF SURFACE SELF-NANOCRYSTALLIZATION OF METALLIC MATERIALS

(75) Inventors: Tianying Xiong, Shenyang (CN); Tiefan Li, Shenyang (CN); Jie Wu, Shenyang (CN); Huazi Jin, Shenyang (CN); Minjie Wu, Shenyang (CN); Jinsheng Chen, Shenyang (CN); Ming Li, Shenyang (CN)

(73) Assignee: Institute of Metal Research (CN)

( * ) Notice: Subject to any disclaimer, the term of this patent is extended or adjusted under 35 U.S.C. 154(b) by 394 days.

(21) Appl. No.: 10/202,241

(22) Filed: Jul. 23, 2002

(65) Prior Publication Data

US 2003/0127160 A1 Jul. 10, 2003

(30) Foreign Application Priority Data

Sep. 29, 2001 (CN) ..... 01128225 A

(51) Int. Cl.[7] ..... C21D 1/74
(52) U.S. Cl. ..... 148/558; 148/605
(58) Field of Search ..... 148/558

(56) References Cited

FOREIGN PATENT DOCUMENTS

FR 2 689 431 10/1993

OTHER PUBLICATIONS

Akamatsu et al., Nanocrystalline Layer Formation In A High–speed Tool Steel Surface By Repeated Intense Pulsed Ion Beam Irradiations(Abstract Only), Purazuma Oyo Kagaku, 9, 63–68, 2001, ISSN: 1340–3214, Publisher: Purazuma Oyo KagaKu Kenkyukai.*

J. Mater. Sie. Technol. 1999, vol. 15(3): 193.

* cited by examiner

*Primary Examiner*—George Wyszomierski
(74) *Attorney, Agent, or Firm*—Charles Berman; Greenberg Traurig LLP

(57) ABSTRACT

The present invention relates to a method of surface treatment of metallic materials, more particularly, to a method of the surface self-nanocrystallization of metallic materials by the bombarding of supersonic fine particles. The method comprises the step of bombarding the surface of metallic substrate material with fine particles at supersonic speed of 300–1200 m/s carried by a compressed gas, which is ejected from a nozzle. The present method can be used for the surface self-nanocrystallization of metallic parts with a complicated structure or a large area, and the nanometer layer obtained is homogeneous. In addition, it can be operated in a simple way with low energy consumption, low cost, high efficiency of production and high surface nanocrystallization rate of from 1 $cm^2$ to 10 $cm^2$/min.

18 Claims, 3 Drawing Sheets

METHOD OF SURFACE SELF-NANOCRYSTALLIZATION OF METALLIC MATERIALS

BACKGROUND OF THE INVENTION

1. Field of the Invention

The present invention relates to a method of surface treatment of metallic materials, more particularly, to a method of nanocrystallizing the surface of metallic materials by bombarding of supersonic fine particles.

2. General Background and State of the Art

It is well known that material failures mostly occur on the surface of materials. Most of material failures, for example, such as fatigue fracture, fretting fatigue, wear, corrosion and the like, are very sensitive to the structure and properties of the material surface. Optimization of surface structures and properties may effectively improve combined properties of the material. As a result, the surface-modification of engineering materials is used in more and more industrial applications to greatly improve the behavior of materials. With the increasing of evidences of novel properties in nanocrystalline materials, it is necessary to provide a method for surface-modifying by the generation of a nanostructured surface layer, through which the combined properties and behavior of the materials can be significantly improved. This kind of surface modification, i.e., surface nanocrystallization (SNC), will greatly enhance the surface properties without changing the chemical composition. For example, the material which surface is nanocrystallized may have a strong and broad-spectrum absorption property. It is also a flexible method which is likely to fulfill specific requirements for structure/property of the surface of the sample. Surface nanocrystallization of materials can be carried out by using various processes. Among them, one is based on various coating and depositing technologies such as PVD, CVD and spraying methods. The coated materials can be either nanometer-sized isolated particles or polycrystalline powders with nano-sized grains. The coated layers and the matrix can be made of different or same materials. The predominant factor of this process is the bonding of the coated layer with the matrix. Another type of surface nanocrystallization is to transform the surface layers of the materials into nanocrystalline states while maintaining the overall composition and/or phases unchanged, and such a method is so-called surface self-nanocrystallization (SSNC).

Most of conventional mechanical surface treatment methods can be used for the SSNC. For example, ultrasonic shot peening (USSP) method has been used in surface self-nanocrystallization of metallic materials [J.Mater.Sic.Technol. 1999, Vol. 15(3): 193.]. In this paper, a concept of surface nanocrystallization (SNC) of metallic materials and surface self-nanocrystallization of metallic materials by ultrasonic shot peening was introduced. French patent No. 2689431 disclosed a method, in which, ultrasonic shot peening is carried out by the vibration of spherical shots (diameter thereof is 2 mm) created by high power ultrasound. The shots are placed in a reflecting chamber (including an ultrasonic concentrator) that is vibrated by a supersonic generator, after which the shots are resonated. Because of the high frequency of the system (20 kHz), the entire surface of the component to be treated is peened with a large number of impacts over a short period of time to obtain nanostructure layer. But this method is not suitable for the treatment of surface of complicated or larger parts.

Russian patent No. 1391135 disclosed a gas-dynamic spraying method for applying a coating. Upon which, the level of thermal stress can substantially reduced, and the thermal chemical action upon coated surface and powder particles can be weakened, and initial structure of the powder material can be preserved and there are no phase transformations, over-saturated structures or evaporation during application and formation of coatings. The aim of the patent only is to form an additional over-layer on the surface of materials but not to realize surface self-nanocrystallization of metallic materials.

INVENTION SUMMARY

It is an object of the present invention to provide a method for the surface self-nanocrystallization of metallic materials, which needs no coating materials and can effectively change the normal surface of metallic materials into nanocrystallized surface.

The present invention provides a method for the surface self-nanocrystallization of metallic materials, comprising the step of bombarding the surface of metallic substrate material with fine particles at supersonic speed of 300–1200 m/s carried by a compressed gas.

BRIEF DESCRIPTION OF THE DRAWINGS

A more complete appreciation of the invention will be readily obtained by reference to the following description of the preferred embodiments and the accompanying drawings in which numerals in different figures represent the same structures or elements, wherein.

DETAILED DESCRIPTION OF THE PREFERRED EMBODIMENTS

Figure 1:
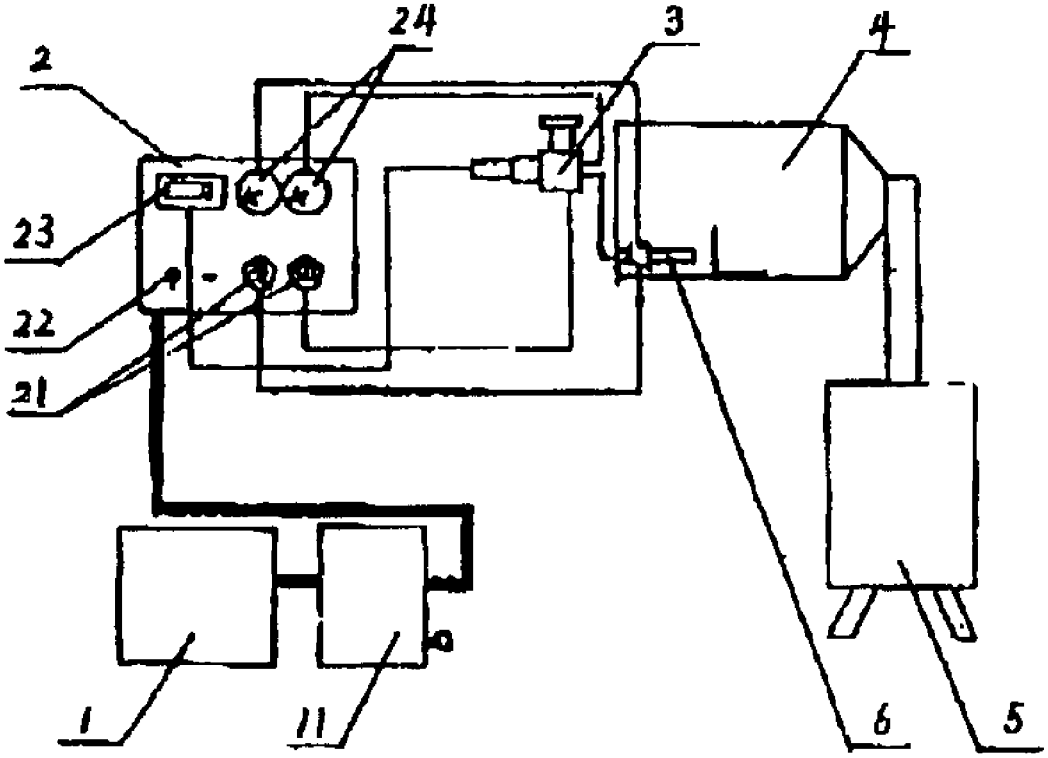
FIG. 1 illustrates the structure of the device used in example 1 of the present invention.

The term "supersonic" used herein means a speed of 300–1200 m/s.

The surface self-nanocrystallization of metallic materials needs no coating materials and can effectively change the normal surface of metallic materials into nanocrystallized surface.

The present invention provides a method for the surface self-nanocrystallization of metallic materials, comprising a step of bombarding the surface of metallic substrate material with fine particles at supersonic speed of 300–1200 m/s carried by a compressed gas which ejected from a nozzle.

According to the present invention, the substrate can be any metallic materials. Among them, carbon steel and 316L stainless steel are the most preferred.

According to the present invention, the metallic substrate surface can be pre-treated by any conventional methods before bombarding. The preferred method is to polish the surface and then wash it with acetone and/or alcohol.

Many fine particles can be used in the present method. Preferably, the fine particles is at least one selected from the group consisting of $\alpha$-$Al_2O_3$, $SiO_2$, BN and WC., et al. Among them, $\alpha$-$Al_2O_3$ and $SiO_2$ are more prefered, $\alpha$-$Al_2O_3$ is the most prefered. The average size of fine particles is depending upon the finished surface desired. Preferably, the average particle size of fine particles is from about 50 nm to about 200 $\mu$m.

Any safe gases can be used in the present invention. Preferably, the compressed gas is air or nitrogen gas.

The bombarding can be carried out continuously, intermittently or half-continuously, preferably continuously.

Many kinds of nozzles can be used to eject the compressed gas. Preferably, the nozzle is Laval.

According to one preferred embodiment of the present invention, the operating parameters are as follows:

Bombarding distance: 5~50 mm

Gas pressure: 1.0~3.0 MPa

Gas flow: 10~30 g/s

Particles feeder voltage: 0~30V (DC)

Gas: air, nitrogen or helium et al.

Fine particle size: 50 nm~200 $\mu$m

Fine particle: $\alpha$-$Al_2O_3$, $SiO_2$, BN or WC et al.

According to another preferred embodiment, the present method comprises the following steps:

1. Pretreatment of metallic materials: the surface is polished and then washed with acetone or alcohol;
2. Compressed gas (typically air, nitrogen, or helium) at pressures from 1–3 MPa is expanded through a converging-diverging or Laval nozzle where it leaves the nozzle at supersonic speed (300–1200 m/s); fine particles are introduced into the gas flow slightly upstream of the converging portion of the nozzle; the expanding gas rapidly accelerates the particles to a very high velocity. The particles impact and bombard the surface of the metallic materials, the operating parameters are as follows:

Bombarding distance: 5~50 mm

Gas pressure: 1.0~3.0 MPa

Gas flow: 10~30 g/s

Particles feeder voltage: 0~30V (DC)

Gas: air, nitrogen or helium et al.

Fine particle size: 50 nm~200 $\mu$m

Fine particle: $\alpha$-$Al_2O_3$, $SiO_2$, BN or WC. et al.

Although the present invention is not bounded by any theory, it is believed that bombarding of a mass of particles with high speed continually and effectively on the surface creates localized severe plastic deformation, which further creates dislocation, twin crystalline structure and subcrystalline structure, as a result, crystal structure is refined and finally nanometer regime is obtained.

The present method has the following advantages:

1. According to the present invention, crystalline grain of the surface of metallic materials can be refined effectively and then form a nanocrystalline layer having a crystalline grain size of about 20 nm, a thickness ranging from about 0.5 to about 50 $\mu$m, and a chemical composition which is completely the same as that of the metallic substrate materials. This optimization of the surface structure may effectively enhance the global behavior of materials, for example, mechanical properties (fatigue, wearability, stress corrosion resistance).
2. The present method can be used for the surface self-nanocrystallization of metallic parts having a complicated structure or a large area, and the nanometer layer obtained is homogeneous.
3. This invention can be operated in a simple way with low energy consumption, low cost, high efficiency of production and high surface nanocrystallization rate ranging from 1 $cm^2$ to 10 $cm^2$/min.

EXAMPLES

Examples 1

The substrate material used is 316L stainless steel tube; the used particles are $\alpha$-$Al_2O_3$ (about 50 $\mu$m). The nanocrystallization was carried out as the following:

(1) Pre-treatment of the substrate material: the surface of the substrate material was polished and then washed with acetone or alcohol;

(2) The parameters of nanocrystallization of the surface were as follows:

Bombarding distance: 15 mm

Gas pressure: 1.75 MPa

Gas flow: 20 g/s

Particles feeder voltage: 15V (DC)

Bombarding time: 6 min.

Microstructural analysis has showed that the average crystalline grain size of the surface of the 316L tube is to be refined from 18 $\mu$m to 14 nm by means of X-ray diffraction and atomic power microscopic techniques.

Figure 2:
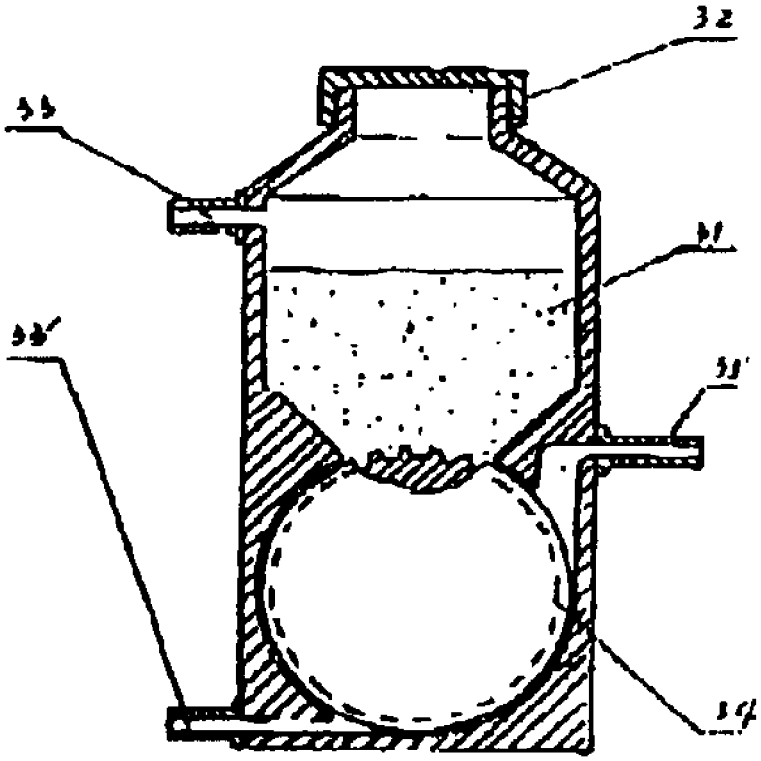
FIG. 2 shows an enlarged figure of the particles feeder in FIG. 1.
Figure 3:
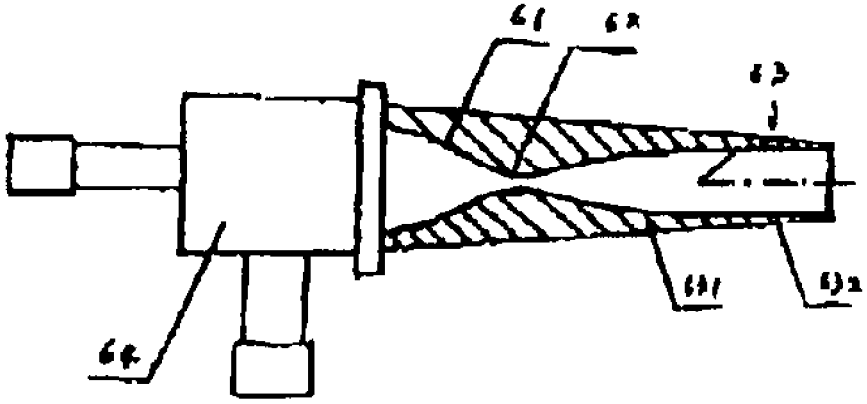
FIG. 3 shows an enlarged figure of the supersonic nozzle component in FIG. 1.

The equipment for applying surface self-nanocrystallization of metallic materials showed as FIG. 1, FIG. 2 and FIG. 3 is consisting of a supersonic nozzle 6, a particles feeder 3, a bombarding chamber 4, a dust exhauster separator collector (DESC) system 5 and a control console 2. The supersonic nozzle 6 is fixed to the inlet of the bombarding chamber 4. The control console 2 is linked to the pipe of compressor 1 having an air reservoir 11, and linked to the particles feeder 3 via the feeder switch 22 and to the supersonic nozzle 6 via a control valve 21. A DESC system 5 is arranged at the outlet of the bombarding chamber 4. The supersonic nozzle 6 and the particles feeder 3 are linked to each other through a pipe. The supersonic nozzle 6 is made up of contracting part 61, throat 62 and expanding part 63. The contracting part 61 of the nozzle is subsonic speed region, which is smoothly and continuously contracted to the throat 62. The expanding part 63 of the nozzle is the supersonic region of an axial symmetry streamlined structure and is connected to the throat 62. It is made up of an initial expanding part 631 and an eliminable part 632. The initial expanding part 631 of the nozzle is a turbulent flow region of a smooth continuous structure. The eliminable part 632 of the nozzle is a uniform flow region of an axial symmetry streamlined structure. The contracting part 61 of the nozzle is connected to the mixing chamber 64, which is connected to the particles feeder 3 through the pipe. The particles feeder 3 is made up of the sealing gland 32, the particles chamber 31, and the compressed air inlet A, B, (33, 33'); the drum 34 and the particles outlet 35. The particle chamber 31 has two separate compressed air inlets A 33, B 33', one is above the particle chamber 31 and the other is below the drum 34 respectively, and they were connected to the control console 2, the air reservoir 11 and the compressor 1 via pipes respectively. The particles chamber 31 has a particles outlet 35, which is connected to the supersonic nozzle 6 through a pipe. The grooves on the drum 34 and inner wall 17 of the bombarding chamber 4 form a slot, through which the compressed air passes from inlet B 33' to the particles outlet 35. The particles feeder 3 and the supersonic nozzle 6 are connected to the control console 2 through the pressure meter 24 thereon respectively. The control console 2 and the particles feeder 3 are linked to each other by the voltmeter 23.

Firstly, the compressed gas controlled by the control console 2 is fed into the particles feeder 3 where the particles are accelerated to a supersonic speed and carried by the compressed gas to pass through the supersonic nozzle 6 to bombard the surface of the substrate material in the bombarding chamber 4 continuously, as a result, plastic deformation of the surface is created and then a mass of dislocation, twin crystal structure or subcrystalline structure are produced. Finally, the crystal grains are refined and a nanocrystalline layer is formed. The crystalline grain size thickness varies in the range of 0.5~50 μm. The residual particles are recovered by the DESC system 5. The control console 2 controls the all process.

The principle of design of supersonic nozzle was given by the equation of fluid mechanics. As to one-dimensional steady fluid, considering the compress fluid, the equation should be:

$$v^2/2+(K/K-1)\cdot P/\rho=\text{constant} \quad (1)$$

$$\rho\cdot v\cdot S=\text{constant} \quad (2)$$

$$P/\rho^k=\text{constant} \quad (3)$$

The following equation can be calculated from the above equations:

$$ds/s=(M^2-1)dv/v \quad (4)$$

In the four above equations: S is cross sectional area of the nozzle; $M=v/v_S$ (Mach number, wherein $v_S$ is velocity of sound); ρ is gas density; K is gas constant; P is gas pressure; v is gas velocity. It can be known from formula (4) that, when $v>v_S$, both dv and ds are positive or both are negative. That is to say, the velocity of gas flow increases as the cross sectional area of a tube increases (ds is positive number). However, when $v<v_S$, one is positive and the other is negative, that is, the velocity of gas flow increases while the cross sectional area of a tube decreases (ds is negative number). Therefor, after the section area of a tube had been contracted fully, the velocity of gas flow is accelerated to a velocity of sound at one cross section of throat after has passed this section, the velocity of gas flow will reach an supersonic speed.

Examples 2

The same procedure was employed in the same manner as in Example 1, except for the following:

The substrate material used is carbon steel plate;

The particles used are WC (about 50 μm);

Gas pressure: 2 MPa

Gas flow: 25 g/s

Particles feeder voltage: 16V (DC)

Bombarding time: 2 min.

Microstructural analysis has showed that the average crystalline grain size of the surface of the carbon steel plate is to be refined from 12 μm to 20 nm by means of X-ray diffraction and atomic power microscopic techniques.

Figure 4:
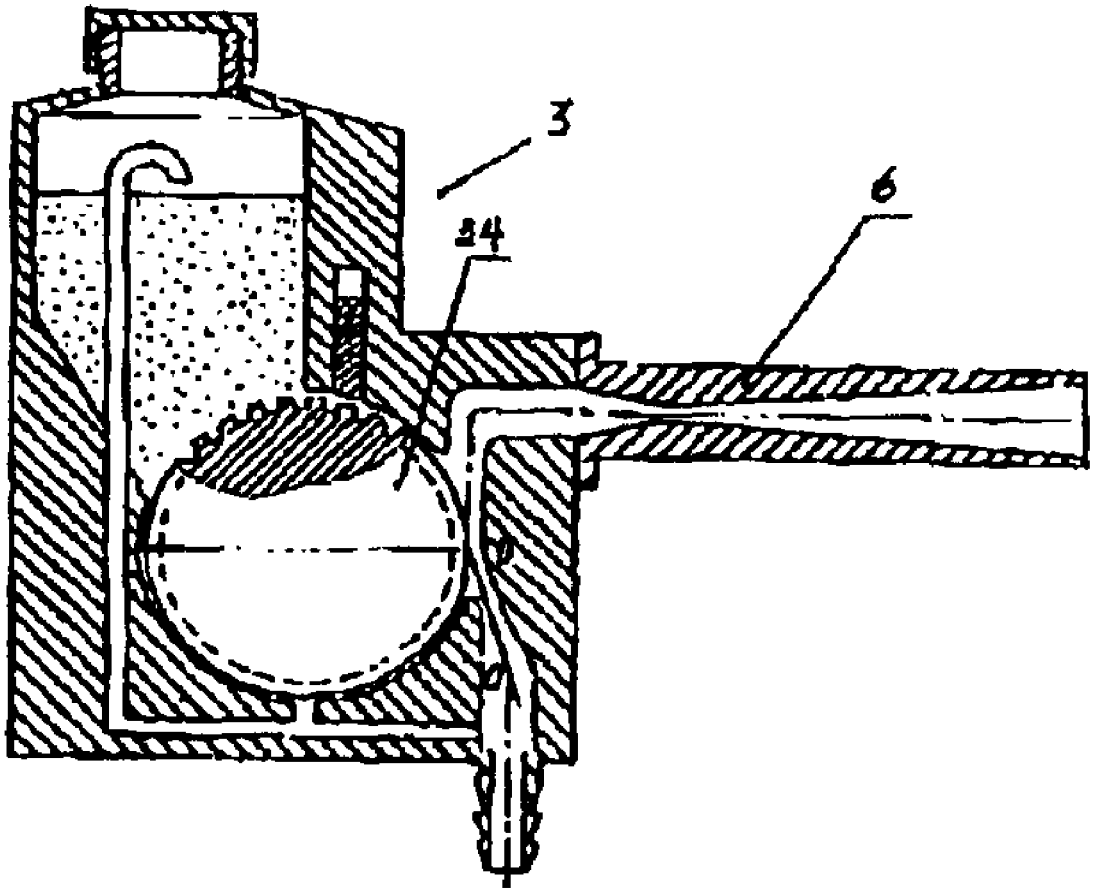
FIG. 4 shows an illustrative structure of the device used in examples 2 of the present invention.

The device used is shown as in FIG. 4, which is disclosed, in Russian patent No. 1674585 (1991), 1603581 (1993), 1618778 (1993), 1773072 (1993), 2010619 (1994).

We claim:

1. A method of surface self-nanocrystallization of metallic materials, comprising a step of bombarding the surface of metallic substrate material with fine particles at approximately supersonic speed carried by a compressed gas which is ejected from a nozzle.

2. A method according to claim 1, wherein said metallic substrate material is metal or alloy.

3. A method as claimed in claim 1, wherein said metallic substrate material is carbon steel and/or stainless steel.

4. A method according to claim 1, wherein said surface of metallic substrate is pre-treated.

5. A method according to claim 4, wherein the fine particles bombard the surface of the metallic substrate material at a speed of at least approximately 300 m/s.

6. A method according to claim 1, wherein said particle is selected from the group consisting of $\alpha$-$Al_2O_3$, $SiO_2$, BN, WC, metallic particles, and mixtures thereof.

7. A method according to claim 1, wherein the average size of said fine particles is in the range from 50 nm to 2000 μm.

8. A method according to claim 1, wherein said compressed gas is selected from the group consisting of air, helium, argon, nitrogen gas and mixtures thereof.

9. A method according to claim 1, wherein said bombarding is carried out continuously.

10. A method according to claim 1, wherein said nozzle is Laval nozzle.

11. A method according to claim 1, wherein the operation parameters of said bombarding are as the following:

bombarding distance: 5~50 mm gas pressure: 1.0~3.0 MPa gas flow: 10~30 g/s particles feeder voltage: 0~30V (DC)

gas: a safe gas fine particle size: 50 nm~200 μm.

12. A method as claimed in claim 11, wherein said safe gas is selected from the group consisting of air, nitrogen, argon, helium and mixtures thereof.

13. A method as claimed in claim 11, wherein said fine particle is selected from the group consisting of $\alpha$-$Al_2O_3$, $SiO_2$, BN, WC, metallic particles, and mixtures thereof.

14. A method according to claim 1, wherein the fine particles bombard the surface of the metallic substrate material at a speed of at most approximately 1200 m/s.

15. A method of surface self-nanocrystallization of metallic materials, comprising a step of bombarding the surface of metallic substrate material with fine particles at a speed of at least approximately 300 m/s carried by a compressed gas which is ejected from a nozzle.

16. A method of surface self-nanocrystallization of metallic materials comprising a step of bombarding the surface of metallic substrate material with fine particles at supersonic speed carried by a compressed gas which is ejected from a nozzle, wherein the fine particles bombard the surface continuously, causing deformation of the surface.

17. A method according to claim 16, wherein the fine particles bombard the surface of the metallic substrate material at a speed of at least approximately 300 m/s.

18. A method according to claim 16, wherein the fine particles bombard the surface of the metallic substrate material at a speed of at most approximately 1200 m/s.

* * * * *